US007408310B2

(12) United States Patent
Hong et al.

(10) Patent No.: US 7,408,310 B2
(45) Date of Patent: Aug. 5, 2008

(54) APPARATUS FOR CONTROLLING DRIVING OF RECIPROCATING COMPRESSOR AND METHOD THEREOF

(75) Inventors: Eon-Pyo Hong, Seoul (KR); Jae-Yoo Yoo, Gyeonggi-Do (KR); Myung-Ryul Lee, Gyeonggi-Do (KR); Kyeong-Bae Park, Seoul (KR); Chel-Woong Lee, Seoul (KR); Gye-Young Song, Seoul (KR); Ki-Chul Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 74 days.

(21) Appl. No.: 11/396,512

(22) Filed: Apr. 4, 2006

(65) Prior Publication Data

US 2006/0228224 A1 Oct. 12, 2006

(30) Foreign Application Priority Data

Apr. 8, 2005 (KR) ..... 10-2005-0029615
Mar. 20, 2006 (KR) ..... 10-2006-0025468

(51) Int. Cl.
*H02K 33/00* (2006.01)

(52) U.S. Cl. ..... 318/119; 417/44.1

(58) Field of Classification Search ..... 318/119
See application file for complete search history.

(56) References Cited

U.S. PATENT DOCUMENTS 6,685,438 B2 * 2/2004 Yoo et al. ..... 417/44.11
6,815,922 B2 11/2004 Yoo et al.
6,851,934 B2 * 2/2005 Yoo et al. ..... 417/44.11
6,930,462 B2 8/2005 Yoo et al.
7,025,571 B2 * 4/2006 Jeun ..... 318/400.08
2003/0164691 A1 * 9/2003 Ueda et al. ..... 318/135
2004/0071556 A1 4/2004 Hong et al.
2004/0239266 A1 * 12/2004 Lee et al. ..... 318/119
2005/0053471 A1 3/2005 Hong et al.
2005/0184687 A1 8/2005 Hong et al.
2005/0271526 A1 * 12/2005 Chang et al. ..... 417/417
2006/0127225 A1 6/2006 Hong et al.

FOREIGN PATENT DOCUMENTS

KR 10-2003 0012262 2/2003

OTHER PUBLICATIONS

English language Abstract of KR 10-2003-0012262, Feb. 12, 2003.

* cited by examiner

*Primary Examiner*—Lincoln Donovan
*Assistant Examiner*—Michael Brandt
(74) *Attorney, Agent, or Firm*—Greenblum & Bernstein, P.L.C.

(57) ABSTRACT

Disclosed are an apparatus for controlling a driving of a reciprocating compressor capable of enhancing an efficiency by differently controlling a frequency and a stroke voltage according to a load size and capable of reducing consumption power, and a method thereof. The apparatus comprises a controlling unit for judging a load size by comparing a phase difference between a detected current and a stroke with a reference phase difference, and outputting a frequency control signal and a stroke control signal according to the judged load size.

8 Claims, 3 Drawing Sheets

APPARATUS FOR CONTROLLING DRIVING OF RECIPROCATING COMPRESSOR AND METHOD THEREOF

BACKGROUND OF THE INVENTION

1. Field of the Invention

The present invention relates to a compressor, and more particularly, to an apparatus for controlling a driving of a reciprocating compressor and a method thereof.

2. Description of the Background Art

Generally, a reciprocating compressor is not provided with a crankshaft for converting a rotary motion into a linear motion thus to have a less frictional loss. Therefore, the reciprocating compressor has more increased compression efficiency than a general compressor.

When the reciprocating compressor is applied to a refrigerator or an air conditioner, a cooling capacity thereof is controlled by varying a compression ratio by varying a stroke voltage inputted thereto. Herein, the stroke denotes a distance between an upper dead point of a piston and a lower dead point.

The conventional reciprocating compressor will be explained with reference to FIG. 1.

FIG. 1 is a block diagram showing a construction of an apparatus for controlling a driving of a reciprocating compressor in accordance with the conventional art.

As shown, the conventional apparatus for controlling a driving of a reciprocating compressor comprises a current detector 4 for detecting a current applied to a motor (not shown) of a reciprocating compressor 6, a voltage detector 3 for detecting a voltage applied to the motor, a stroke calculator 5 for calculating a stroke estimation value of the compressor according to the detected current and voltage and a parameter of the motor, a comparator 1 for comparing the calculated stroke estimation value with a preset stroke command value and thus outputting a difference value therebetween, and a stroke controller 2 for controlling a stroke of the compressor 6 by varying a voltage applied to the motor by controlling a turn-on cycle of a triac (not shown) connected to the motor in serial according to the difference value.

Hereinafter, an operation of the apparatus for controlling a driving of the reciprocating compressor according to the present invention will be explained with reference to FIG. 1.

The current detector 4 detects a current applied to a motor (not shown) of the compressor 6, and outputs the detected current value to the stroke calculator 5. The voltage detector 3 detects a voltage applied to the motor, and outputs the detected voltage value to the stroke calculator 5.

The stroke calculator 5 calculates a stroke estimation value (X) of the compressor by substituting the detected current value, the detected voltage value, and a parameter of the motor into the following formula 1, and then applies the calculated stroke estimation value (X) to the comparator 1.

$$X = \frac{1}{\alpha}\int (V_m - Ri - L\dot{i})dt \qquad \text{formula 1}$$

Herein, the R denotes a resistance value, the L denotes a motor inductance value, the $\alpha$ denotes a motor constant, the $V_m$ denotes a voltage applied to the motor, the i denotes a current applied to the motor, and the $\dot{i}$ denotes a variation ratio of a current applied to the motor according to time. That is, the $\dot{i}$ denotes a differential value of the i (di/dt).

Then, the comparator 1 compares the stroke estimation value with the stroke command value, and applies a difference value therebetween to the stroke controller 2.

The stroke controller 2 varies a voltage applied to the motor of the compressor 6 according to the difference value, thereby controlling a stroke of the compressor 6.

FIG. 2 is a flowchart showing a method for controlling a driving of a reciprocating compressor in accordance with the conventional art.

When a stroke estimation value obtained by the stroke calculator 5 is applied to the comparator 1 (S1), the comparator 1 compares the stroke estimation value with a preset stroke command value thereby to obtain a difference value therebetween (S2). Then, the comparator 1 outputs the difference value to the stroke controller 2.

When the stroke estimation value is less than the stroke command value, the stroke controller 2 increases a voltage to be applied to the motor in order to control a stroke of the compressor (S3). On the contrary, when the stroke estimation value is greater than the stroke command value, the stroke controller 2 decreases a voltage to be applied to the motor (S4). Herein, the stroke controller 2 increases or decreases a voltage to be applied to the motor by controlling a turn-on cycle of a triac (not shown) electrically connected to the motor.

The stroke command value is varied according to a size of a load of the reciprocating compressor. That is, when the load of the reciprocating compressor is large, the stroke command value is increased not to decrease a stroke of a piston thereby to prevent a cooling capacity from being decreased. On the contrary, when the load of the reciprocating compressor is small, the stroke command value is decreased not to increase a stroke of a piston thereby to prevent a cooling capacity from being increased and to prevent a collision between the piston and a cylinder due to an over stroke.

The conventional linear compressor using a stroke voltage has a decreased efficiency when a stroke of a piston is decreased into a certain level, thereby having a limitation in implementing a capacity variation.

The conventional rotary compressor using a rotation motor implements a capacity variation of a wide range by varying a frequency. When a frequency is varied within a range of a small capacity variation, the efficiency of the rotary compressor is not drastically decreased. On the contrary, when a stroke of a piston is small, the efficiency of the reciprocating compressor is decreased.

BRIEF DESCRIPTION OF THE INVENTION

Therefore, an object of the present invention is to provide an apparatus for controlling a driving of a reciprocating compressor capable of increasing an efficiency of a driving motor by judging a load according to a phase difference between a current and a stroke applied to the reciprocating compressor and then by controlling a driving frequency and a stroke according to the judged load, and a method thereof.

To achieve these and other advantages and in accordance with the purpose of the present invention, as embodied and broadly described herein, there is provided an apparatus for controlling a driving of a reciprocating compressor, comprising: a controlling unit for judging a load size by comparing a phase difference between a current and a stroke with a reference phase difference, and outputting a frequency control signal and a stroke control signal according to the judgment result; a driving frequency command value determining unit for determining a driving frequency command value according to the frequency control signal; a stroke command value determining unit for determining a stoke command value according to the stroke control signal; a first comparing unit for comparing the driving frequency command value with a current driving frequency, and outputting a frequency compensation signal according to the comparison result; a second comparing unit for comparing the stroke command value with a current stroke, and outputting a stroke compensation signal according to the comparison result; a PWM controlling unit for outputting a PWM control signal to vary a driving frequency and a stroke according to the frequency compensation signal and the stroke compensation signal; and an inverter for varying a voltage and a driving frequency applied to a motor according to the PWM control signal.

To achieve these and other advantages and in accordance with the purpose of the present invention, as embodied and broadly described herein, there is also provided a method for controlling a driving of a reciprocating compressor, comprising: driving a reciprocating compressor with a capacity corresponding to a certain stroke command value; detecting a current and a voltage applied to a motor of the reciprocating compressor, and calculating a stroke by the detected current and voltage; detecting a phase difference between the calculated stroke and the current; comparing the detected phase difference with a reference phase difference, and varying a stroke command value and a driving frequency command value according to the comparison result; comparing the varied driving frequency command value with a current driving frequency, and generating a frequency compensation signal according to the comparison result; comparing the varied stroke command value with a current command value, and generating a stroke compensation signal according to the comparison result; generating a PWM control signal to vary a stroke voltage and a driving frequency according to the frequency compensation signal and the stroke compensation signal; and varying a stroke voltage and a driving frequency applied to a motor of the reciprocating compressor according to the PWM control signal.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, with reference to FIGS. 3 and 4, will be explained an apparatus for controlling a driving of a reciprocating compressor capable of driving the reciprocating compressor of a high load by a linear compressor having the same capacity and capable of reducing a consumption power in a main driving state by judging a load size according to a phase difference between a current and a stroke applied to the reciprocating compressor and by controlling a current driving frequency and a stroke according to the judgment result, and a method thereof.

Figure 1:
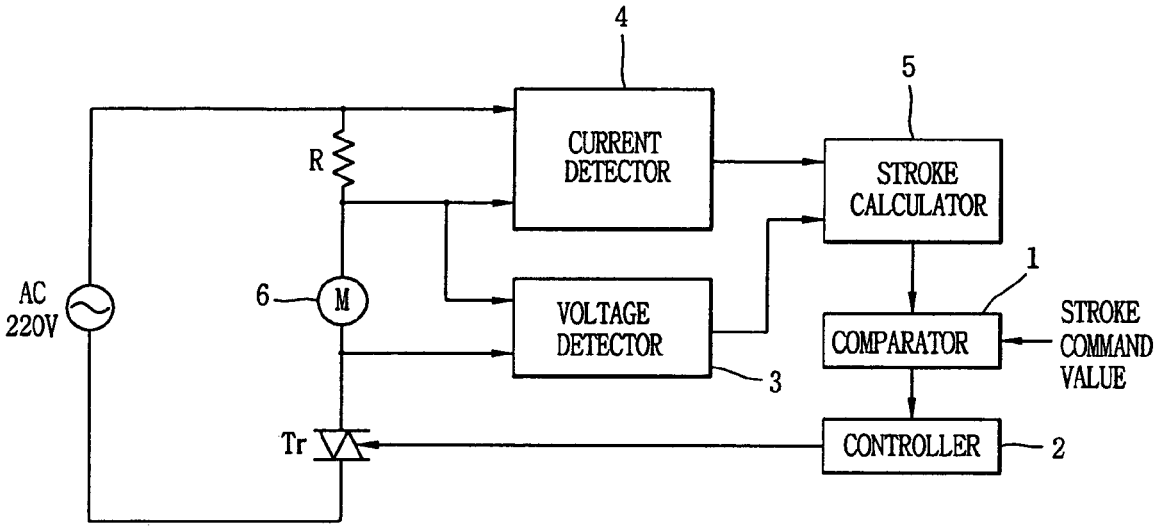
FIG. 1 RELATED ART
FIG. 1 is a block diagram showing a construction of an apparatus for controlling a driving of a reciprocating compressor in accordance with the conventional art.
Figure 2:
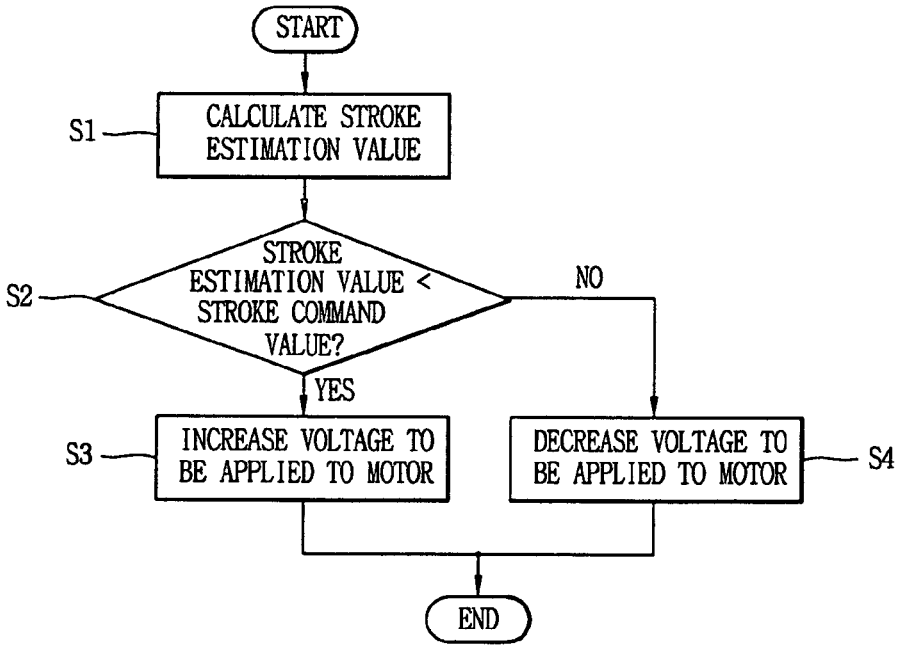
FIG. 2 RELATED ART
FIG. 2 is a flowchart showing a method for controlling a driving of the reciprocating compressor in accordance with the conventional art.
Figure 3:
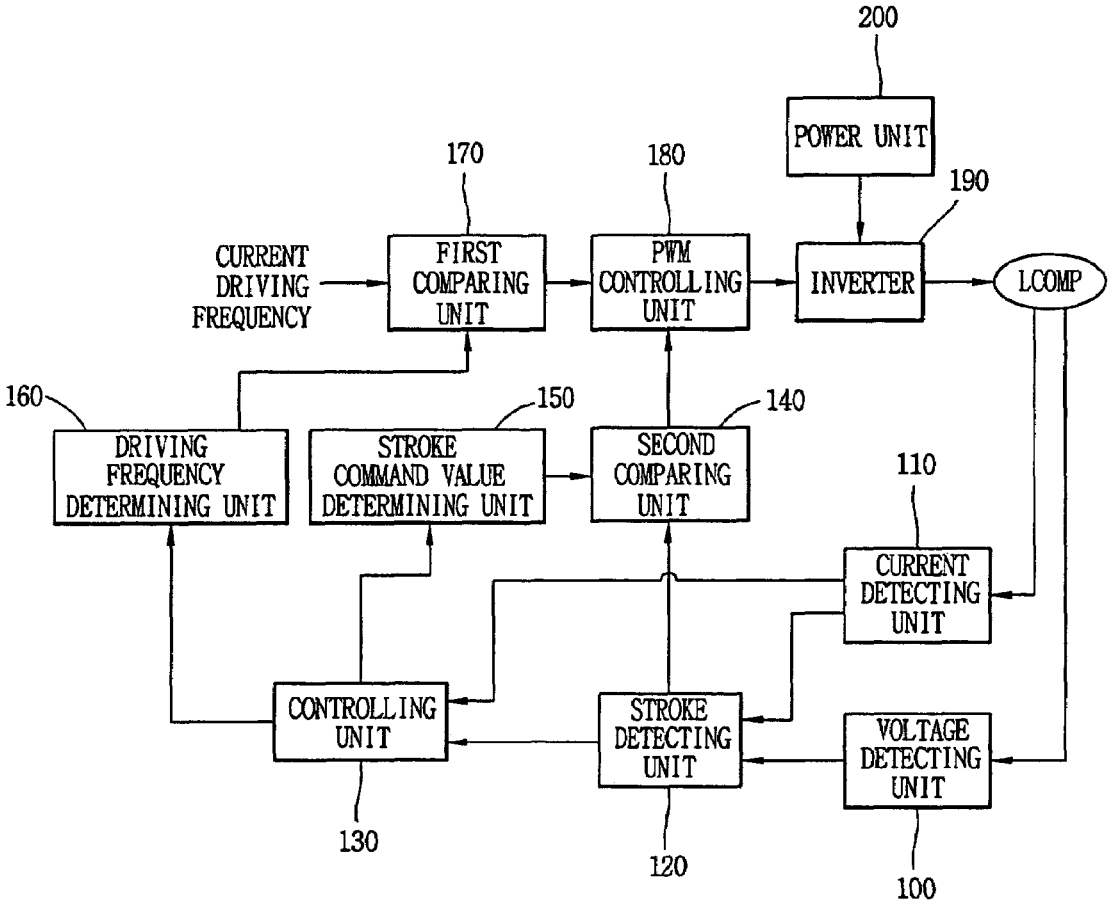
FIG. 3 is a block diagram showing a construction of an apparatus for controlling a driving of a reciprocating compressor according to the present invention.

FIG. 3 is a block diagram showing a construction of an apparatus for controlling a driving of a reciprocating compressor according to the present invention.

As shown, the apparatus for controlling a driving of a reciprocating compressor according to the present invention comprises a voltage detecting unit 100, a current detecting unit 110, a stroke detecting unit 120, a controlling unit 130, first and second comparing units 140 and 170, a stroke command value determining unit 150, a driving frequency determining unit 160, a PWM controlling unit 180, an inverter 190, and a power unit 200.

The current detecting unit 110 detects a current of a motor of a linear compressor, and the voltage detecting unit 100 detects a voltage of a motor of a linear compressor.

The stroke detecting unit 120 calculates a stroke by the detected current and voltage.

The controlling unit 130 compares a phase difference between the detected current and the stroke with a reference phase difference thereby to judge whether the result value corresponds to a high load. Then, the controlling unit 130 outputs a frequency control signal and a stroke control signal according to the judgment result.

As a first embodiment of the controlling unit 130, when a phase difference between the detected current and the stroke is less than a reference phase difference, the controlling unit 130 judges a load of the reciprocating compressor as a high load and thus outputs a frequency control signal to vary a current driving frequency into a driving frequency larger than a resonance frequency.

As a second embodiment of the controlling unit 130, when a phase difference between the detected current and the stroke is less than a reference phase difference, the controlling unit 130 judges a load of the reciprocating compressor as a high load and thus outputs a frequency control signal to vary a current stroke into a full stroke.

As a third embodiment of the controlling unit 130, when a phase difference between the detected current and the stroke is less than a reference phase difference, the controlling unit 130 judges a load of the reciprocating compressor as a high load and thus outputs a frequency control signal to vary a current driving frequency into a driving frequency larger than a resonance frequency, and outputs a stroke control signal to vary a current stroke into a full stroke.

As a fourth embodiment of the controlling unit 130, when a phase difference between the detected current and the stroke is larger than a reference phase difference, the controlling unit 130 judges a load of the reciprocating compressor as a normal load (a low load or a middle load) and thus outputs a stroke control signal for varying a capacity (a capacity within a range of 30 to 90% of a maximum capacity).

As a fifth embodiment of the controlling unit 130, when a phase difference between the detected current and the stroke is larger than a reference phase difference, the controlling unit 130 judges a load of the reciprocating compressor as a normal load (a low load or a middle load) and thus outputs a frequency control signal for varying a current driving frequency into a resonance frequency.

As a sixth embodiment of the controlling unit 130, when a phase difference between the detected current and the stroke is larger than a reference phase difference, the controlling unit 130 judges a load of the reciprocating compressor as a normal load (a low load or a middle load) and thus outputs a stroke control signal for varying a capacity and a frequency control signal for varying a current driving frequency into a resonance frequency.

In order to detect the resonance frequency, the controlling unit 130 varies a frequency and a stroke so that a phase difference between the detected current and the stroke can be 90°, or varies a frequency and a stroke so that a phase difference between a velocity and a current of the reciprocating compressor can be 0°, or directly calculates a gas spring constant.

The controlling unit 130 can generate a load by a pre-stored experimental value by detecting a user's set temperature or an external temperature.

The driving frequency command value determining unit 160 determines a driving frequency command value for varying a driving frequency according to the frequency control signal.

The stroke command value determining unit 150 determines a stroke command value for varying a stroke according to the stroke control signal.

The first comparing unit 170 compares the driving frequency command value with a current driving frequency, and outputs a frequency compensation signal according to the comparison result.

The second comparing unit 140 compares the stroke command value with a current stroke, and outputs a stroke compensation signal according to the comparison result.

The PWM controlling unit 180 outputs a PWM control signal to vary a driving frequency and a stroke according to the frequency compensation signal and the stroke compensation signal.

Herein, the PWM control signal comprises a PWM duty ratio varying signal for varying a stroke voltage applied to the motor of the reciprocating compressor, and a PWM period varying signal for varying a frequency of a voltage applied to the reciprocating compressor.

The inverter 190 varies a voltage and a driving frequency applied to the motor of the reciprocating compressor according to the PWM control signal.

The inverter 190 is used to generate an AC power of an optional frequency so as to vary a velocity of a motor by using a supply voltage (AC 50 Hz or 60 Hz). The usage of the inverter 190 has the following advantages. First, a speed variation of the motor of the reciprocating compressor is facilitated, energy saving is implemented, and the efficiency of the reciprocating compressor is enhanced by applying a low frequency rather than a high frequency.

That is, the inverter 190 controls on/off time of an inner switching device by the PWM control signal, and varies a frequency of a DC power and a voltage level outputted from the power unit 200 thereby to apply to the motor of the reciprocating compressor.

Herein, the power unit 200 rectifies and smoothens an AC power thereby to generate a certain DC power.

Hereinafter, an operation of the apparatus for controlling a driving of a reciprocating compressor will be explained in more detail with reference to FIG. 4.

Figure 4:
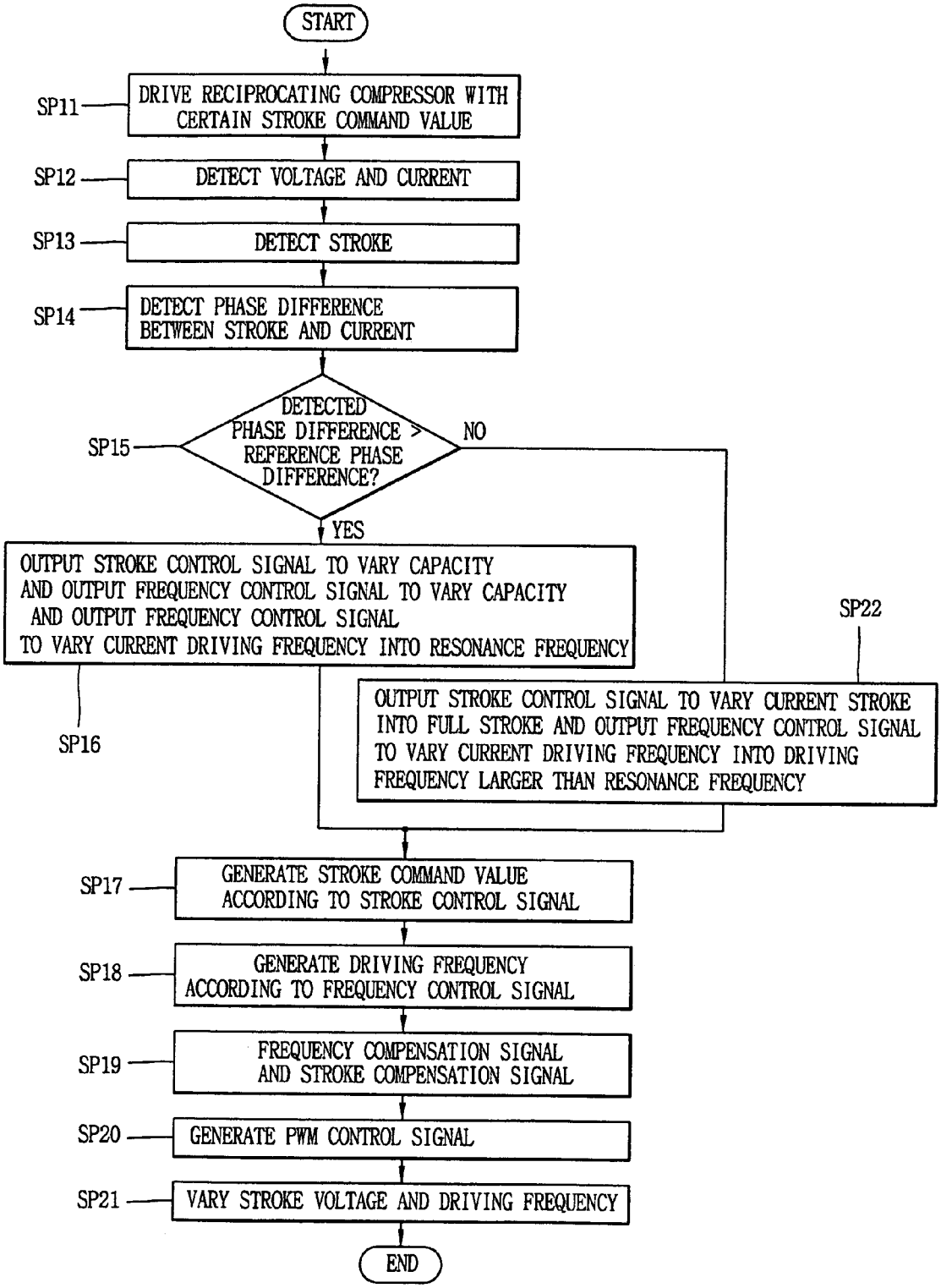
FIG. 4 is a flowchart showing a method for controlling a driving of the reciprocating compressor according to the present invention.

FIG. 4 is a flowchart showing a method for controlling a driving of a reciprocating compressor according to the present invention.

First, a motor of a reciprocating compressor is driven with a certain stroke command value (SP11).

Then, the current detecting unit 110 detects a current of the motor of the reciprocating compressor, and the voltage detecting unit 100 detects a voltage of the motor of the reciprocating compressor (SP12).

Then, the stroke detecting unit 120 calculates a stroke by using the detected current and the detected voltage (SP13).

Then, the controlling unit 130 detects a phase difference between the detected current and the stroke (SP14), and compares the phase difference with a reference phase difference (SP15).

The reference phase difference is set to have an optimum value by experiments.

When a load of the reciprocating compressor is increased, a gas spring constant is increased and thus a phase difference between a current and a stroke is decreased.

That is, when a phase difference between a current and a stroke is 90°, a resonance frequency corresponding to a middle load is generated. Also, when a phase difference between a current and a stroke is 60°, a resonance frequency corresponding to a high load is generated, which is certified by experiments.

Accordingly, the reference phase difference is set to have a value larger than 60°.

The reference phase difference is set at a point smaller than a point where a TDC=0.

The TDC denotes a top dead center of a piston of a reciprocating compressor, and signifies a position of a piston that has completed a stroke process.

When the TDC is positioned at '0', the efficiency of the reciprocating compressor is the maximized. Therefore, the reciprocating compressor is controlled so that the piston can be positioned at a point of TDC=0.

As one embodiment, when a phase difference between a current and a stroke is smaller than a reference phase difference, the controlling unit 130 judges a load of the reciprocating compressor as a high load and thus outputs a frequency control signal for varying a current driving frequency into a driving frequency larger than a resonance frequency.

As another embodiment, when a phase difference between a current and a stroke is smaller than a reference phase difference, the controlling unit 130 judges a load of the reciprocating compressor as a high load and thus outputs a stroke control signal for varying a current stroke into a full stroke.

As still another embodiment, when a phase difference between a current and a stroke is smaller than a reference phase difference, the controlling unit 130 judges a load of the reciprocating compressor as a high load, outputs a frequency control signal for varying a current driving frequency into a driving frequency larger than a resonance frequency, and outputs a stroke control signal for varying a current stroke into a full stroke (SP22).

The stroke command value determining unit 150 determines a stroke command value for varying a current stroke into a full stroke according to a stroke control signal outputted from the controlling unit 130, and applies it to the second comparing unit 140 (SP17).

The driving frequency command value determining unit 160 determines a driving frequency larger than a resonance frequency as a driving frequency command value according to a frequency control signal outputted from the controlling unit 130, and applies it to the first comparing unit 170 (SP18).

The driving frequency command value is set according to a load size by an experiment.

The first comparing unit 170 compares the driving frequency command value with a current driving frequency, and applies a frequency compensation signal according to the comparison result to the PWM controlling unit 180 (SP19).

The second comparing unit 140 compares the stroke command value with a current stroke, and applies a stroke compensation signal according to the comparison result to the PWM controlling unit 180 (SP19).

Then, the PWM controlling unit 180 applies a PWM control signal according to the frequency compensation signal outputted form the first comparing unit 170 and the stroke compensation signal outputted from the second comparing unit 140 to the inverter 190 (SP20). The inverter 190 varies a stroke voltage and a driving frequency applied to the motor of the reciprocating compressor according to the PWM control signal (SP21).

As one embodiment, when a phase difference between a current and a stroke applied to the motor of the reciprocating compressor is larger than a reference phase difference, the controlling unit 130 judges a load of the reciprocating compressor as a normal load (a middle load or a low load) and thus outputs a stroke control signal for varying a driving capacity of the reciprocating compressor.

As another embodiment, when a phase difference between a current and a stroke applied to the motor of the reciprocating compressor is larger than a reference phase difference, the controlling unit 130 outputs a frequency control signal for varying a driving frequency into a resonance frequency.

As a preferable embodiment, when a phase difference between a current and a stroke applied to the motor of the reciprocating compressor is larger than a reference phase difference, the controlling unit 130 judges a load of the reciprocating compressor as a normal load (a middle load or a low load), outputs a frequency control signal for varying a current driving frequency into a resonance frequency, and outputs a stroke control signal for varying a driving capacity of the reciprocating compressor (SP16).

The stroke command value determining unit 150 determines a stroke command value for varying a driving capacity of the reciprocating compressor into a driving capacity corresponding to a current load according to a stoke control signal outputted from the controlling unit 130, and applies it to the second comparing unit 140 (SP17).

The driving frequency command value determining unit 160 determines a resonance frequency as a driving frequency command value according to a frequency control signal outputted from the controlling unit 130, and applies it to the first comparing unit 170 (SP18).

The first comparing unit 170 compares the driving frequency command value with a current driving frequency, and applies a frequency compensation signal according to the comparison result to the PWM controlling unit 180 (SP19).

The second comparing unit 140 compares the stroke command value with a current stroke, and applies a stroke compensation signal according to the comparison result to the PWM controlling unit 180 (SP19).

Then, the PWM controlling unit 180 applies a PWM control signal according to the frequency compensation signal outputted form the first comparing unit 170 and the stroke compensation signal outputted from the second comparing unit 140 to the inverter 190 (SP20). The inverter 190 varies a stroke voltage and a driving frequency applied to the motor of the reciprocating compressor according to the PWM control signal (SP21).

In the present invention, a size of a current load is judged by comparing a phase difference between a current and a stroke applied to the reciprocating compressor with a reference phase difference. If the current load is judged as a high load, a current driving frequency is varied into a driving frequency larger than a resonance frequency, and a current stroke is varied into a full stroke. Accordingly, it is possible to correspond to a load more than a high load by using the reciprocating compressor having the same capacity.

Also, in the present invention, a size of a current load is judged by comparing a phase difference between a current and a stroke applied to the reciprocating compressor with a reference phase difference. If the current load is judged as a middle load or a low load, a stroke control signal for varying a capacity is outputted, and a current driving frequency is varied into a driving frequency. Accordingly, consumption power can be enhanced in a main driving state of a refrigerator or an air conditioner.

That is, in the reciprocating compressor of the present invention, a maximum cooling capacity is not always generated but a necessary cooling capacity is generated by controlling a stroke. Accordingly, consumption power can be reduced.

As aforementioned, in the apparatus for controlling a driving of a reciprocating compressor and the method thereof according to the present invention, a size of a current load is judged by comparing a phase difference between a current and a stroke applied to the reciprocating compressor with a reference phase difference. If the current load is judged as a high load, a current driving frequency is varied into a driving frequency larger than a resonance frequency, and a current stroke is varied into a full stroke. Accordingly, it is possible to correspond to a load more than a high load by using the reciprocating compressor having the same capacity, and thus the efficiency of the reciprocating compressor can be enhanced.

Also, in the present invention, a size of a current load is judged by comparing a phase difference between a current and a stroke applied to the reciprocating compressor with a reference phase difference. If the current load is judged as a middle load or a low load, a stroke control signal for varying a capacity is outputted, and a current driving frequency is varied into a driving frequency. Accordingly, consumption power can be enhanced in a main driving state of a refrigerator or an air conditioner.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. An apparatus for controlling a driving of a reciprocating compressor, comprising:

a controlling unit which judges a size of a load by comparing a phase difference between a detected current and a stroke with a reference phase difference, the controlling unit being configured to output a frequency control signal and a stroke control signal according to the judged load size, wherein when the phase difference between the detected current and the stroke is less than the reference phase difference, the controlling unit outputs a frequency control signal to vary a current driving frequency into a driving frequency larger than a resonance frequency.

2. An apparatus for controlling a driving of a reciprocating compressor, comprising:

a controlling unit which judges a load size by comparing a phase difference between a current and a stroke with a reference phase difference, and outputting a frequency control signal and a stroke control signal according to the judgment result;

a driving frequency command value determining unit which determines a driving frequency command value according to the frequency control signal;

a stroke command value determining unit which determines a stoke command value according to the stroke control signal;

a first comparing unit which compares the driving frequency command value with a current driving frequency, the first comparing unit outputting a frequency compensation signal according to the comparison result;

a second comparing unit which compares the stroke command value with a current stroke, the second comparing unit outputting a stroke compensation signal according to the comparison result;

a PWM controlling unit which outputs a PWM control signal to vary a driving frequency and a stroke according to the frequency compensation signal and the stroke compensation signal; and an inverter which varies a voltage and a driving frequency applied to a motor according to the PWM control signal.

3. The apparatus of claim 2, wherein when the phase difference between the detected current and the stroke is less than the reference phase difference, the controlling unit outputs a frequency control signal to vary a current driving frequency into a driving frequency larger than a resonance frequency.

4. The apparatus of claim 2, wherein the PWM control signal includes a PWM duty ratio varying signal which varies a stroke voltage.

5. The apparatus of claim 2, wherein the PWM control signal includes a PWM period varying signal which varies a frequency of a stroke voltage applied to the reciprocating compressor.

6. A method for controlling a driving of a reciprocating compressor, comprising:

driving a reciprocating compressor with a capacity corresponding to a certain stroke command value;

detecting a current and a voltage applied to a motor of the reciprocating compressor, and calculating a stroke by the detected current and voltage;

detecting a phase difference between the calculated stroke and the detected current; and comparing the detected phase difference with a reference phase difference, and varying a stroke command value and a driving frequency command value according to the comparison result, wherein the varying a stroke command value and the driving frequency command value, when the detected phase difference between the current and the stroke is less than the reference phase difference, comprises varying a current driving frequency into a driving frequency larger than a resonance frequency.

7. A method for controlling a driving of a reciprocating compressor, comprising:

driving a reciprocating compressor with a capacity corresponding to a certain stroke command value;

detecting a current and a voltage applied to a motor of the reciprocating compressor, and calculating a stroke by the detected current and voltage;

detecting a phase difference between the calculated stroke and the current;

comparing the detected phase difference with a reference phase difference, and varying a stroke command value and a driving frequency command value according to the comparison result;

comparing the varied driving frequency command value with a current driving frequency, and generating a frequency compensation signal according to the comparison result;

comparing the varied stroke command value with a current command value, and generating a stroke compensation signal according to the comparison result;

generating a PWM control signal to vary a stroke voltage and a driving frequency according to the frequency compensation signal and the stroke compensation signal; and varying a stroke voltage and a driving frequency applied to a motor of the reciprocating compressor according to the PWM control signal.

8. The method of claim 7, wherein the PWM control signal comprises a PWM duty ratio varying signal for varying a stroke voltage, and a PWM period varying signal which varies a frequency of a stroke voltage applied to the reciprocating compressor.

* * * * *

UNITED STATES PATENT AND TRADEMARK OFFICE

CERTIFICATE OF CORRECTION

PATENT NO. : 7,408,310 B2
APPLICATION NO. : 11/396512
DATED : August 5, 2008
INVENTOR(S) : Eon-Pyo Hong et al.

It is certified that error appears in the above-identified patent and that said Letters Patent is hereby corrected as shown below:

On the Title Page, References Cited (56), U.S. Patent Documents, 7,025,571 of the printed patent "318/400.08" should be --417/44.11--.

At Column 9, Line 15 (Claim 2, Line 12) of the printed patent, "stoke" should be --stroke--.

Signed and Sealed this

Twenty-fourth Day of March, 2009

John Doll

JOHN DOLL
*Acting Director of the United States Patent and Trademark Office*